US011733013B2

(12) United States Patent
Tseng

(10) Patent No.: US 11,733,013 B2
(45) Date of Patent: Aug. 22, 2023

(54) HAND GRENADE FOR LAUNCHING BB BULLETS

(71) Applicant: Jui-Fu Tseng, New Taipei (TW)

(72) Inventor: Jui-Fu Tseng, New Taipei (TW)

(73) Assignee: Worlite Industrial Co., Ltd., New Taipei (TW)

( * ) Notice: Subject to any disclaimer, the term of this patent is extended or adjusted under 35 U.S.C. 154(b) by 0 days.

(21) Appl. No.: 17/810,354

(22) Filed: Jul. 1, 2022

(65) Prior Publication Data

US 2023/0132075 A1 Apr. 27, 2023

(51) Int. Cl.

| | |
|---|---|
| ***F42B 27/00*** | (2006.01) |
| ***F42B 12/56*** | (2006.01) |
| ***F41B 11/62*** | (2013.01) |
| ***F41B 11/89*** | (2013.01) |
| *F42B 6/10* | (2006.01) |
| *F42B 8/26* | (2006.01) |
| *F42B 12/40* | (2006.01) |

(52) U.S. Cl.

CPC ..... *F42B 27/00* (2013.01); *F41B 11/62* (2013.01); *F41B 11/89* (2013.01); *F42B 12/56* (2013.01); *F42B 6/10* (2013.01); *F42B 8/26* (2013.01); *F42B 12/40* (2013.01)

(58) Field of Classification Search

CPC ..... F42B 6/00; F42B 6/10; F42B 8/00; F42B 8/26; F42B 12/40; F42B 12/56; F42B 12/58; F42B 12/60; F42B 27/00; F42B 30/00; F41B 11/60; F41B 11/62; F41B 11/80; F41B 11/81; F41B 11/89; F42C 1/00; F42C 1/10

USPC .... 102/482, 498, 502, 529, 513; 124/57, 70, 124/71, 73, 75

See application file for complete search history.

(56) References Cited

U.S. PATENT DOCUMENTS 4,944,521 A * 7/1990 Greeno ..... F42B 12/50 473/577
5,590,886 A * 1/1997 Lush ..... F42B 8/26 473/577
5,996,503 A * 12/1999 Woodall ..... F42B 8/26 102/482

(Continued)

FOREIGN PATENT DOCUMENTS

CN 201275417 Y * 7/2009 ..... A63H 33/00

OTHER PUBLICATIONS

Machine translation of CN-201275417-Y (Year: 2009).*

*Primary Examiner* — James S Bergin

(57) ABSTRACT

A hand grenade for launching BB bullets includes two half shells each including a spiral bullet storage and one half shell further including a discharge opening; a hollow, cylindrical base including a bottom recess, an air passage communicating with one bullet storage, and a valve at an end of the air passage; a steel ball on the recess to block the valve; a pressing assembly including a disc urging against the steel ball, a hollow cylinder extending upward from the disc, a magnet in the hollow cylinder, and a rod partially in the hollow cylinder to engage with the magnet; a hollow, cylindrical member threadedly secured to the cylindrical base; a cup-shaped cap threadedly secured to the cylindrical member and including two opposite projections on an inner surface and a bottom through hole with the rod passing through; and a switch including two opposite protrusions under the projections respectively.

1 Claim, 8 Drawing Sheets

(56) References Cited

U.S. PATENT DOCUMENTS

| | | | | |
|---|---|---|---|---|
| 6,453,819 | B1 * | 9/2002 | Coates | F42B 8/26 102/513 |
| 7,784,455 | B1 * | 8/2010 | Chong | F41B 11/62 124/75 |
| 10,190,843 | B2 * | 1/2019 | Chong | F42B 8/02 |

* cited by examiner

HAND GRENADE FOR LAUNCHING BB BULLETS

FIELD OF THE INVENTION

The invention relates to non-lethal hand grenades and more particularly to a hand grenade for launching BB bullets as protection.

BACKGROUND OF THE INVENTION

A conventional device for launching BB bullets is shaped as a hand grenade. However, after use the safety pin cannot be returned to its original position since it has been pulled out by pulling the pull ring.

Thus, the need for improvement still exists.

SUMMARY OF THE INVENTION

It is therefore one object of the invention to provide a hand grenade for launching BB bullets comprising two half shells threadedly secured together wherein the half shells each comprise a spiral bullet storage on an inner surface and one of the half shells further comprises a discharge opening; and a mechanism disposed in the assembled half shells and comprising a hollow, cylindrical base including a recess on a bottom, an air passage in fluid communication with one of the bullet storages, and a valve at an inner end of the air passage and disposed in the recess; a steel ball on the recess to block the valve; a pressing assembly including a bottom disc urging against the steel ball, a hollow cylinder extending upward from a center of the bottom disc, a magnet in a bottom of the hollow cylinder, a rod having a lower portion in the hollow cylinder to engage with the magnet, and a pin disposed through the hollow cylinder and the rod to fasten the hollow cylinder and the rod together; an intermediate, hollow, cylindrical member threadedly secured to the hollow, cylindrical base; a cup-shaped cap threadedly secured to the intermediate, hollow, cylindrical member and including two opposite projections on an inner surface, a well, and a through hole through a bottom of the well with an upper portion of the rod passing through; and a switch including a handle on a top and two opposite protrusions disposed under the projections respectively; wherein the upper portion of the rod is secured to the switch, the intermediate, hollow, cylindrical member is filled with pressurized air, and the magnet attracts the steel ball in position.

The above and other objects, features and advantages of the invention will become apparent from the following detailed description taken with the accompanying drawings

DETAILED DESCRIPTION OF THE INVENTION

Figure 1:
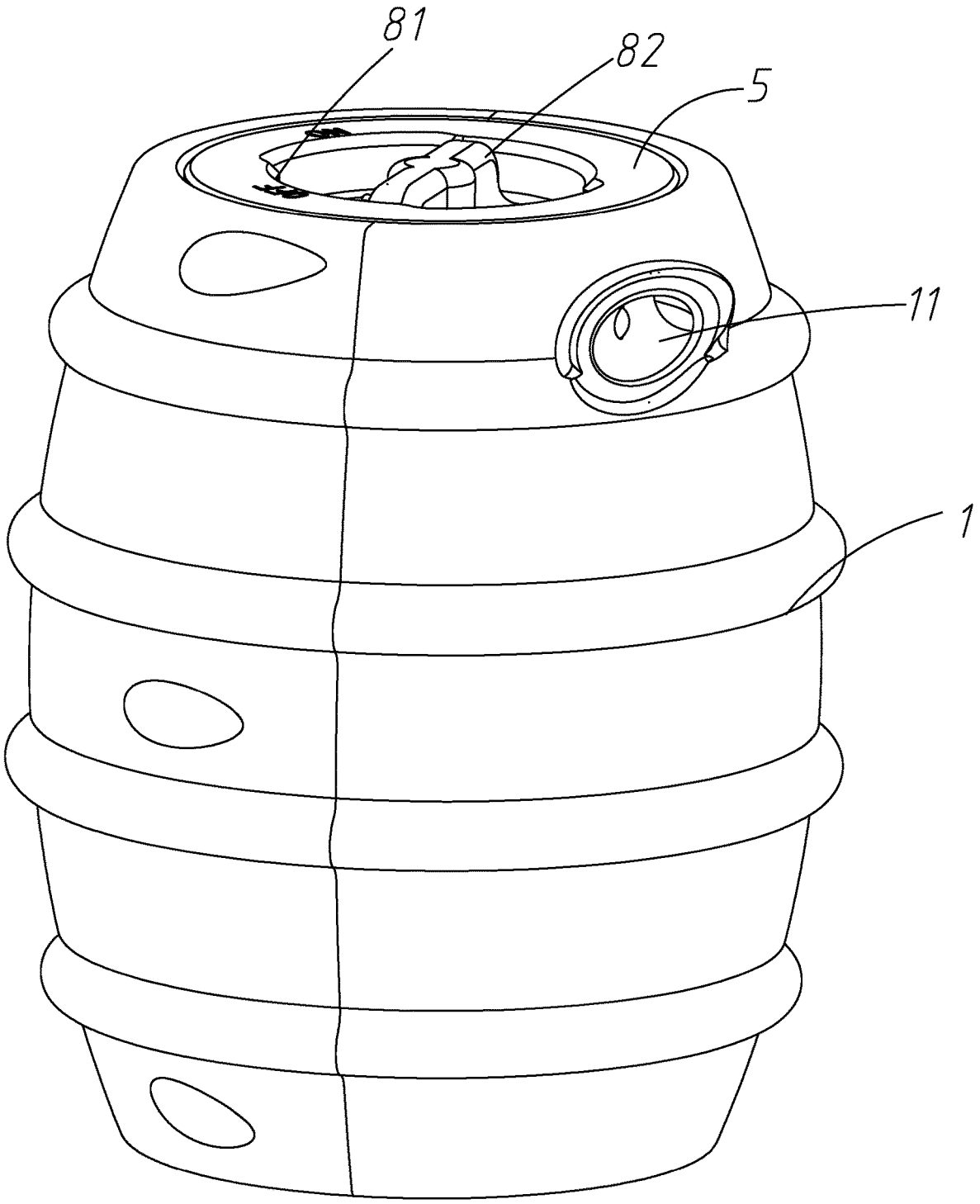
FIG. 1 is a perspective view of a hand grenade for launching BB bullets of the invention.
Figure 2:
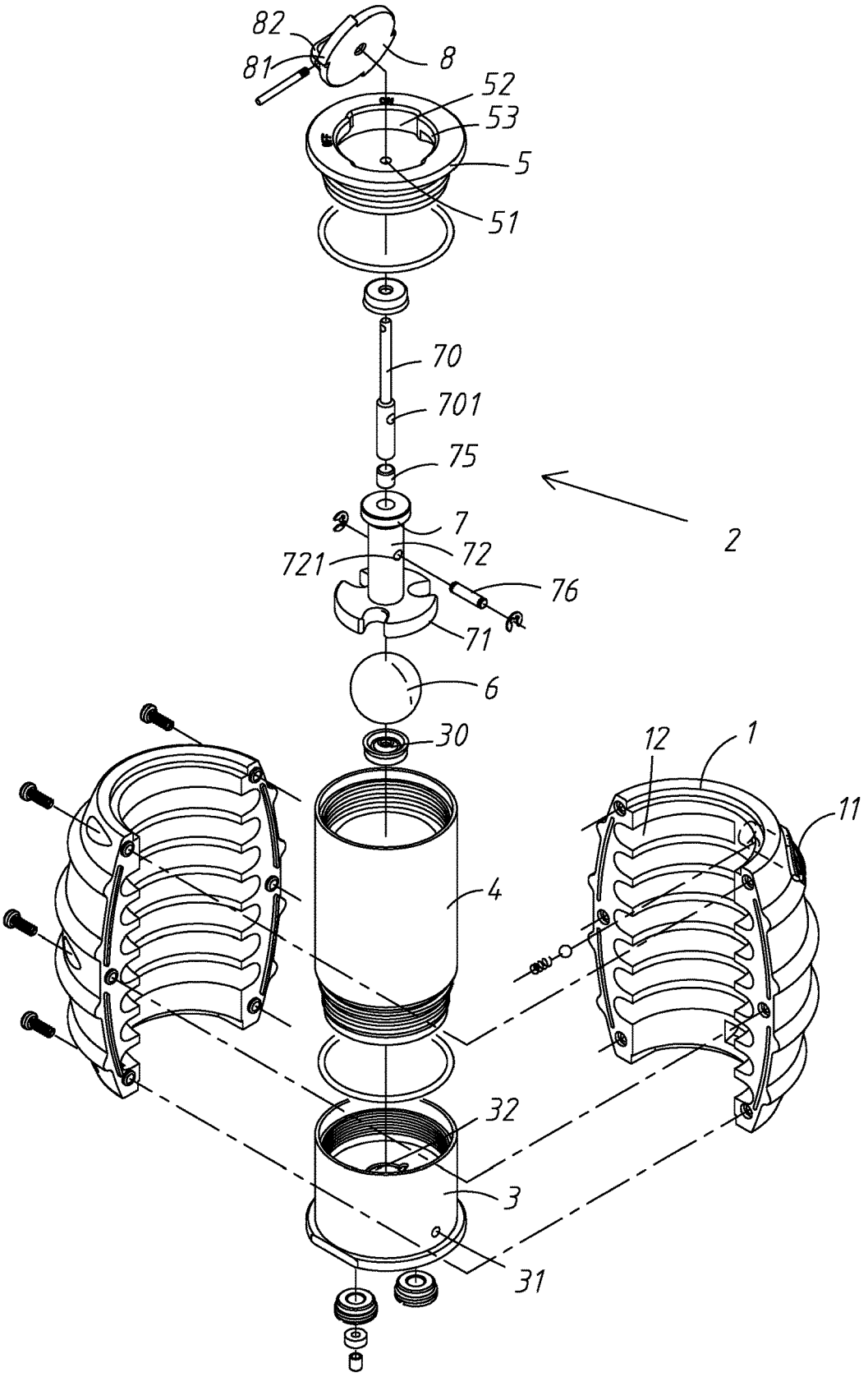
FIG. 2 is an exploded view of the hand grenade for launching BB bullets.
Figure 3:
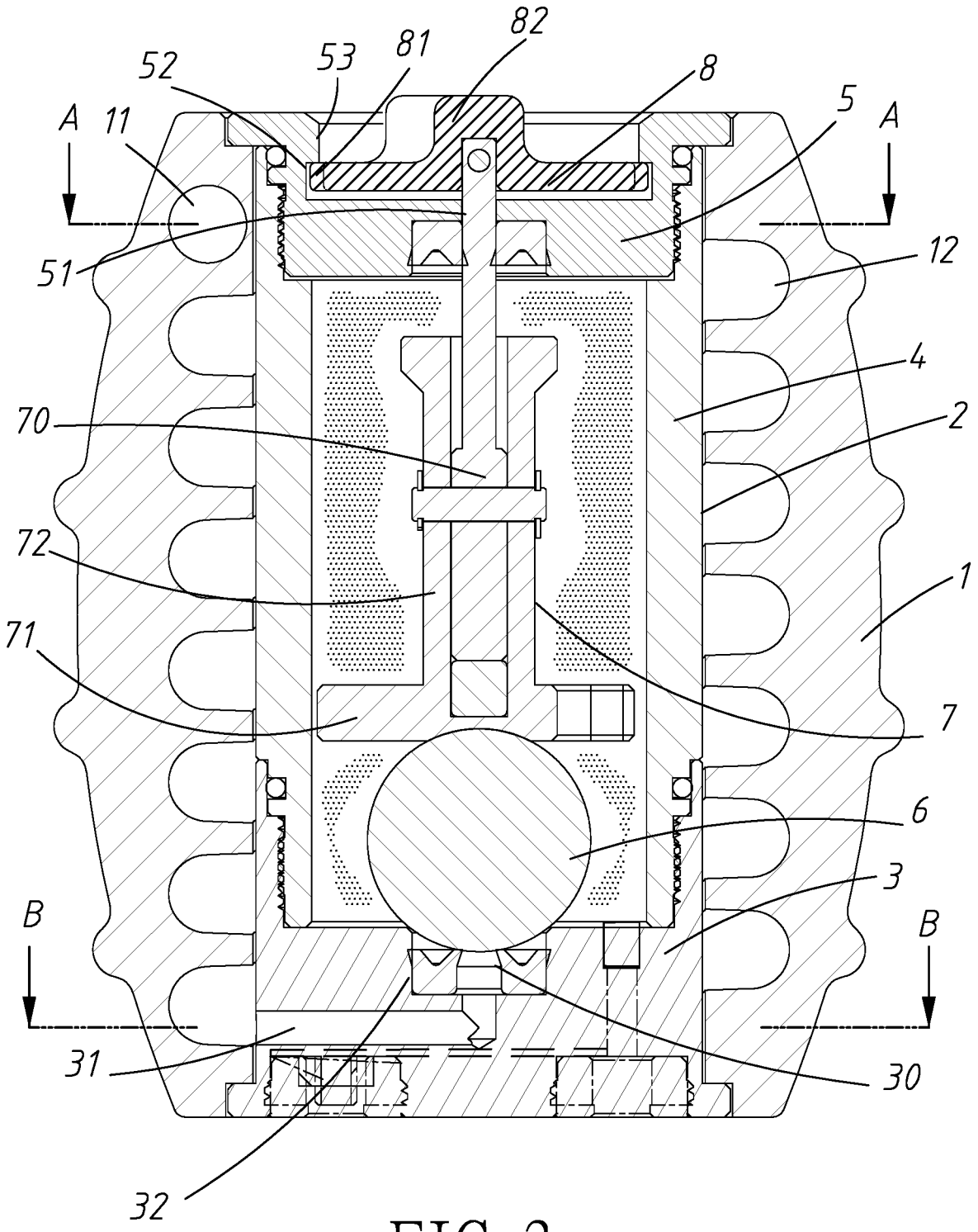
FIG. 3 is a longitudinal sectional view of the hand grenade for launching BB bullets.
Figure 4:
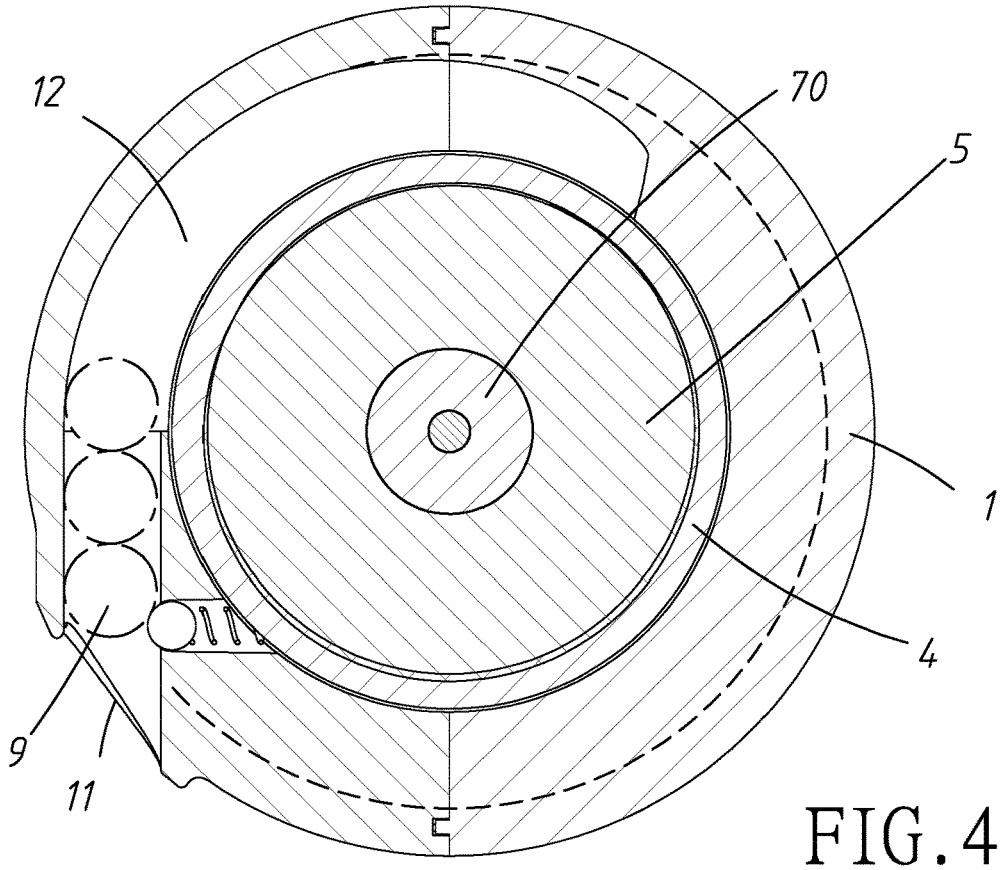
FIG. 4 is a sectional view taken along line A-A of FIG. 3.
Figure 5:
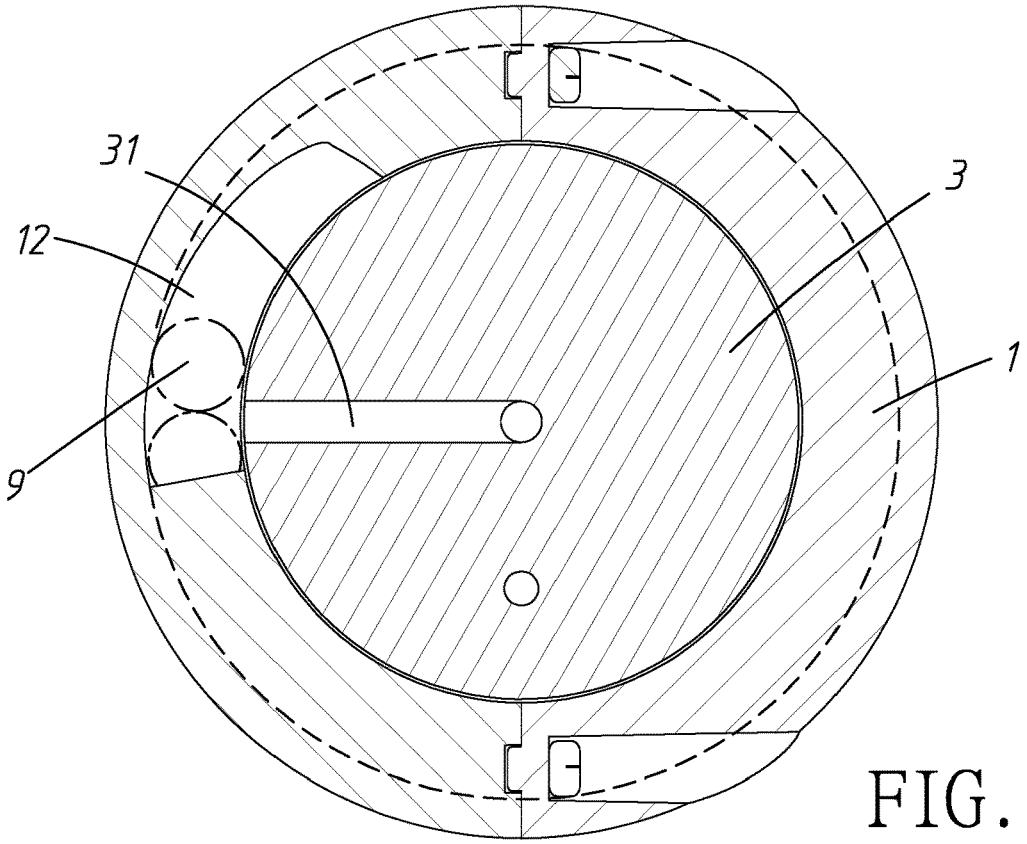
FIG. 5 is a sectional view taken along line B-B of FIG. 3.
Figure 6:
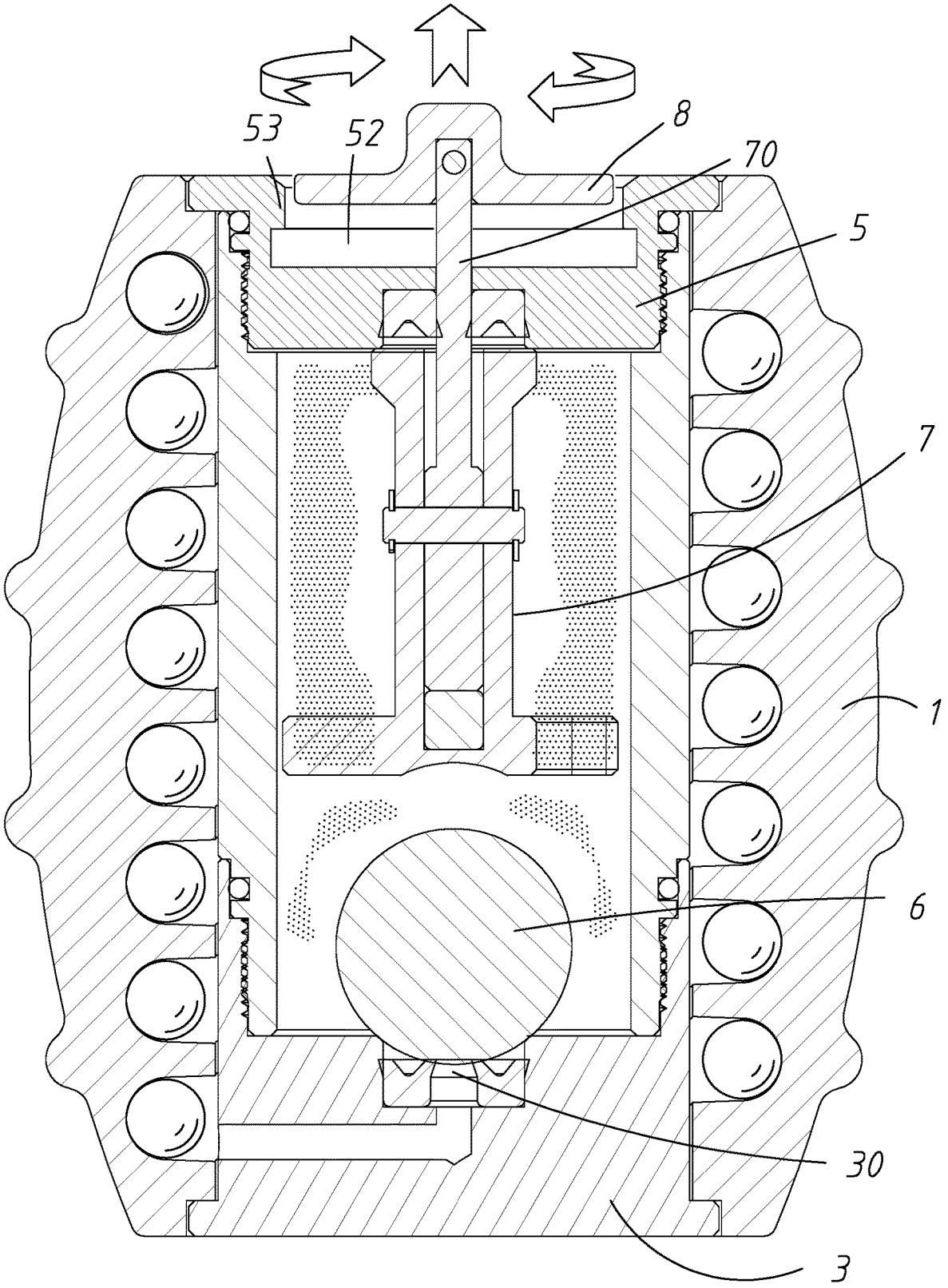
FIG. 6 is a view similar to FIG. 3 in a ready to discharge position.
Figure 7:
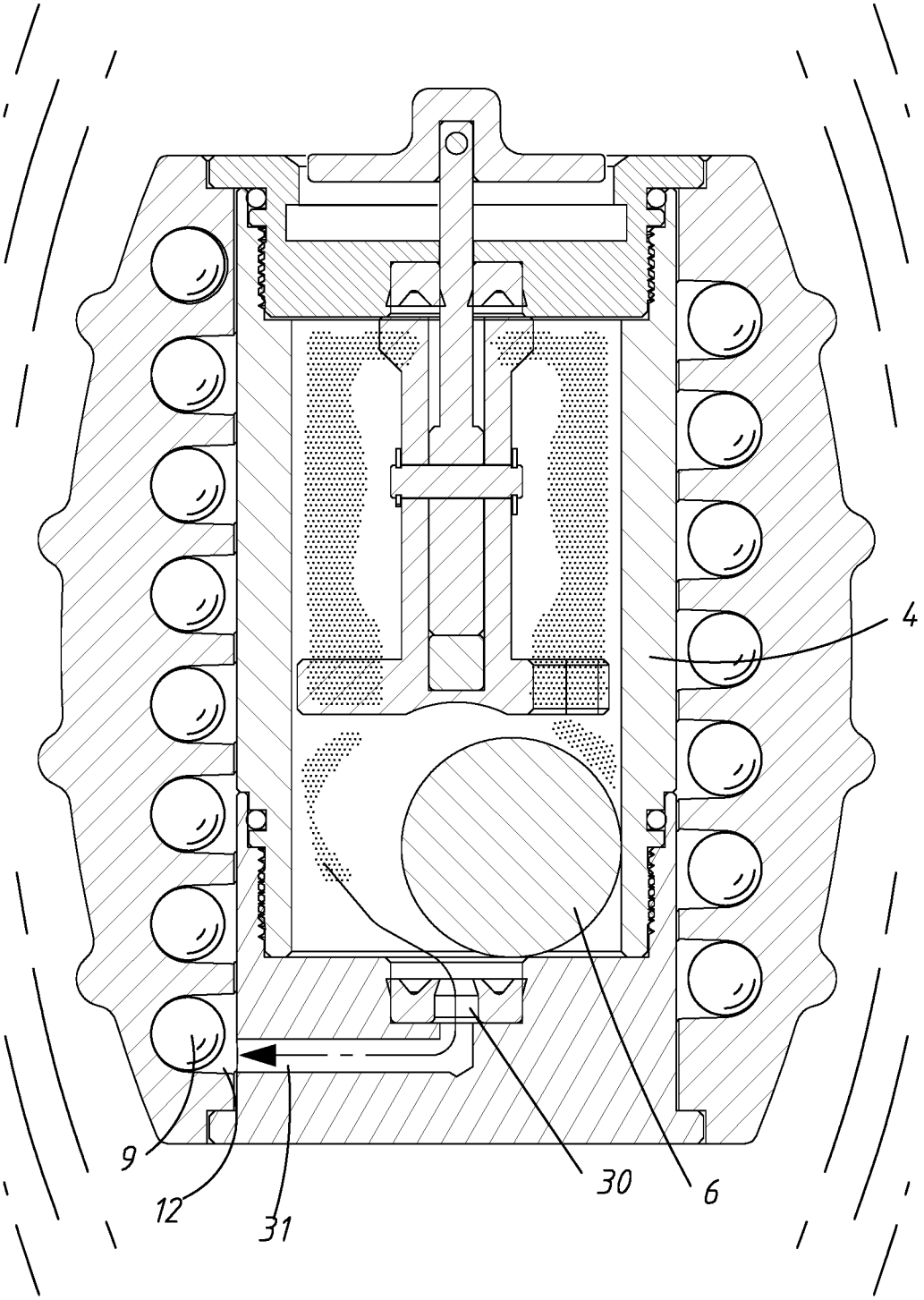
FIG. 7 is a view similar to FIG. 6 where the steel ball has moved to unblock the air passage.
Figure 8:
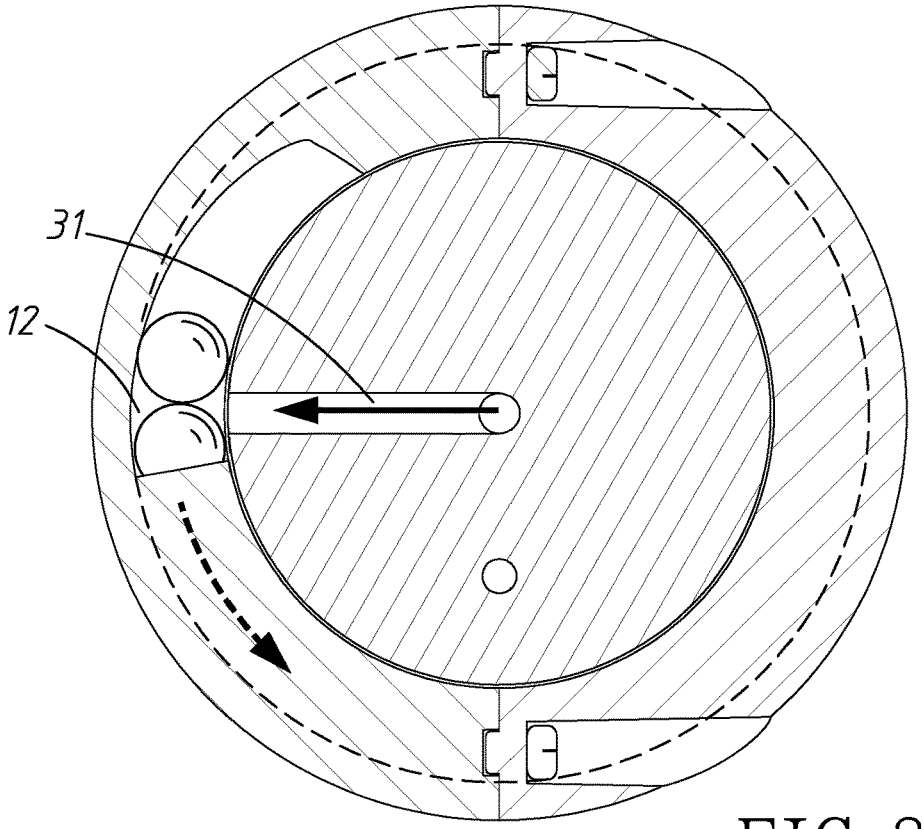
FIG. 8 is a view similar to FIG. 5 showing the BB bullets being ready to discharge.
Figure 9:
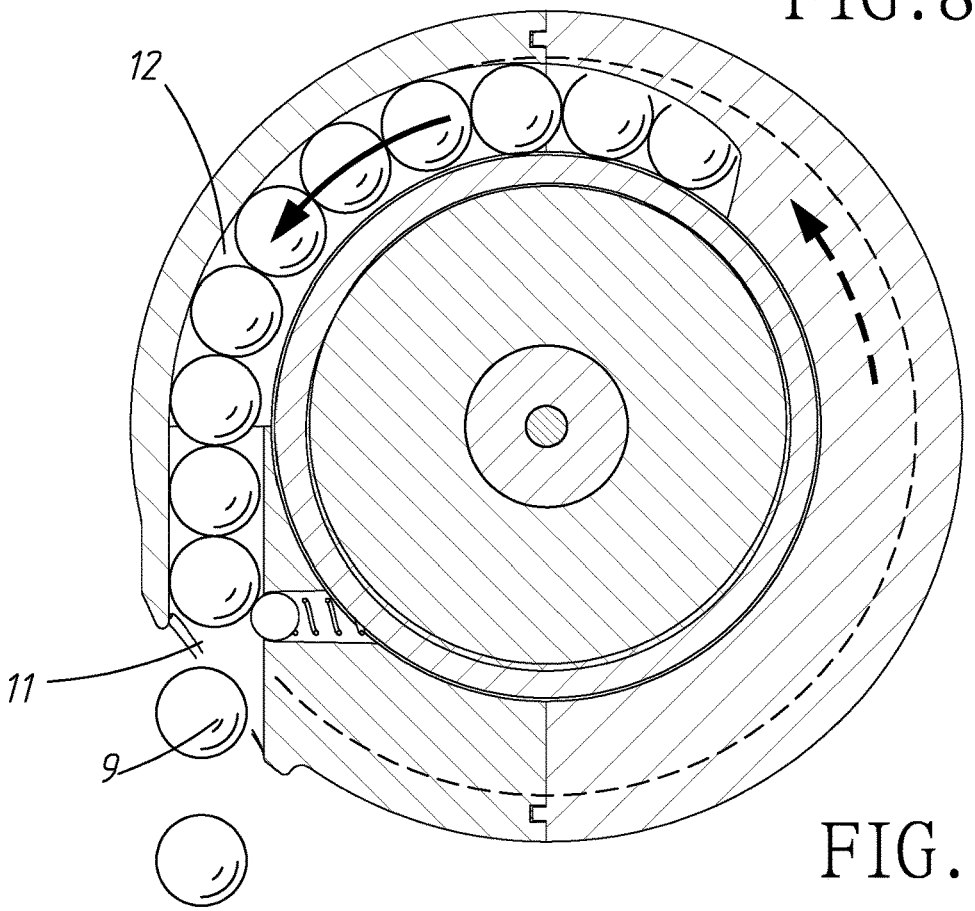
FIG. 9 is a view similar to FIG. 4 showing the BB bullets being discharged.
Figure 10:
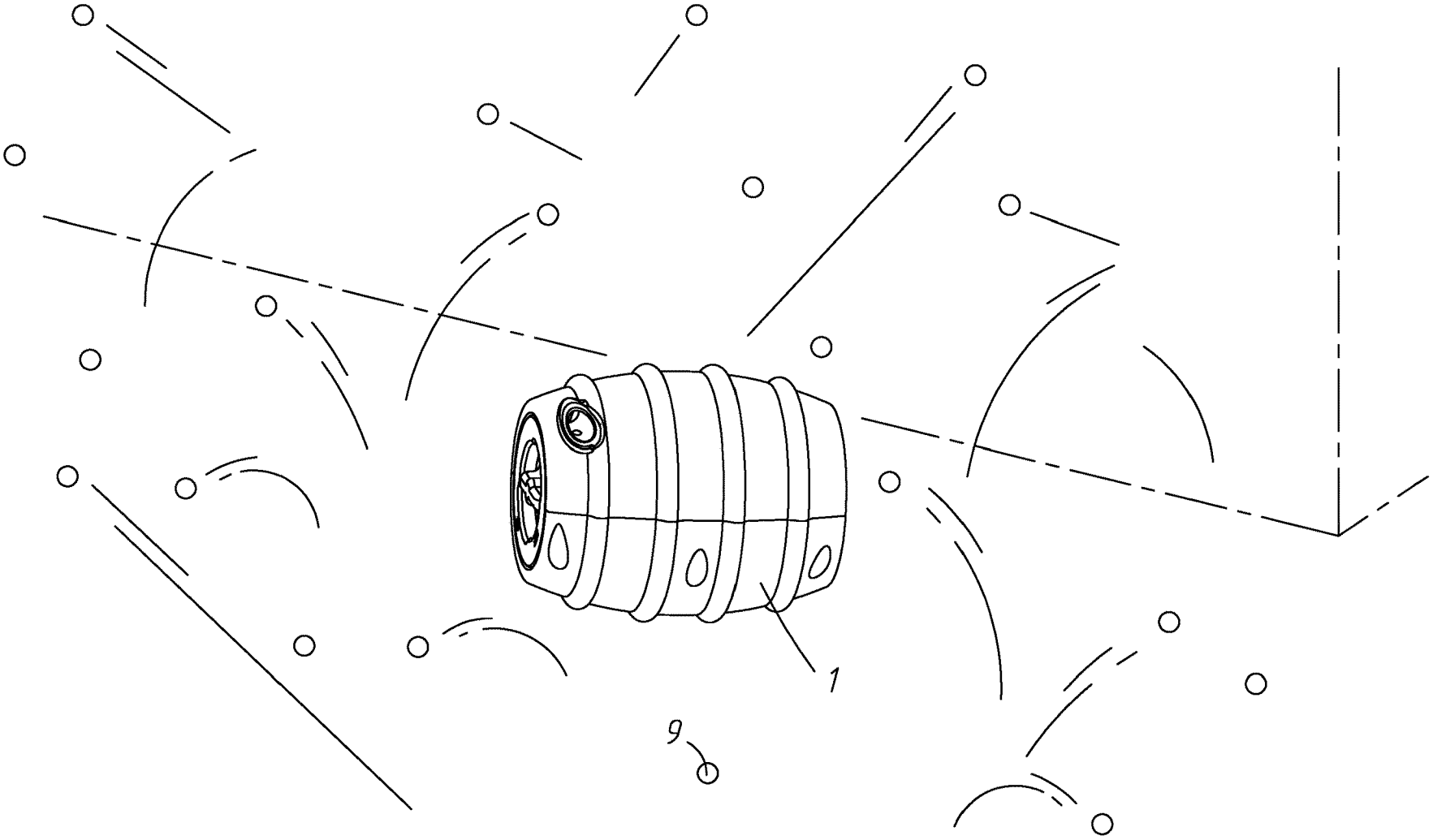
FIG. 10 is an environmental view showing BB bullets having been discharged out of the hand grenade for launching BB bullets.

Referring to FIGS. 1 to 10, a hand grenade for launching BB bullets (e.g., paintballs) of the invention comprises two half shells 1 threadedly secured together in which each half shell 1 includes a spiral bullet storage 12 on an inner surface and one half shell 1 further comprises a discharge opening 11 proximate the top; and a mechanism 2 disposed in the assembled half shells 1 and including a hollow, cylindrical base 3 having a recess 32 on a bottom, an air passage 31 in fluid communication with a bottom of one of the bullet storages 12, and a valve 30 at an inner end of the air passage 31 and disposed in the recess 32; a steel ball 6 on the recess 32 to block the valve 30; a pressing assembly 7 including a bottom disc 71 urging against the steel ball 6, a hollow cylinder 72 extending upward from a center of the bottom disc 71, a magnet 75 in a bottom of the hollow cylinder 72, a rod 70 having a lower portion in the hollow cylinder 72 to engage the magnet 75, and a pin 76 disposed through two aligned holes 721 of the hollow cylinder 72 and a through hole 701 of the rod 70 to fasten the hollow cylinder 72 and the rod 70 together; an intermediate, hollow, cylindrical member 4 threadedly secured to the hollow, cylindrical base 3; a cup-shaped top cap 5 threadedly secured to the intermediate, hollow, cylindrical member 4 and including two opposite projections 53 on an inner surface, a well 52, and a through hole 51 through a bottom of the well 52 with an upper portion of the rod 70 passing through; and a switch 8 including a handle 82 on a top and two opposite protrusions 81 disposed under the projections 53 respectively in which the upper portion of the rod 70 is secured to the switch 8, the intermediate, hollow, cylindrical member 4 is filled with pressurized air, and the magnet 75 attracts the steel ball 6 in position.

In use, a user may clockwise rotate the handle 82 to dispose the protrusions 81 each between the projections 53 and pull the handle 82 upward. And in turn, the pressing assembly 7 moves upward to unfasten the steel ball 6. A subsequent throwing of the hand grenade for launching BB bullets in the air moves the steel ball 6 sideway due to reaction of the throwing action. Thus, the air passage 31 is unblocked and in turn the pressurized air flows through the valve 30 and the air passage 31 to push the BB bullets 9 disposed in the bullet storages 12 out of the discharge opening 11.

After use, the user may push the handle 82 downward and counterclockwise rotate the handle 82 to dispose the protrusions 81 under the projections 53. And in turn, the pressing assembly 7 moves downward so that the magnet 75 may attract the steel ball 6 in position to block the valve 30.

While the invention has been described in terms of preferred embodiments, those skilled in the art will recognize that the invention can be practiced with modifications within the spirit and scope of the appended claims.

What is claimed is:

1. A hand grenade for launching BB bullets comprising: two half shells threadedly secured together wherein the half shells each comprise a spiral bullet storage on an inner surface with a plurality of BB bullets disposed therein and one of the half shells further comprises a discharge opening; and a mechanism disposed in the assembled half shells and comprising a hollow, cylindrical base including a recess in a bottom end thereof, an air passage in fluid communication with one of the bullet storages, and a valve at an inner end of the air passage and disposed in the recess; a steel ball on the recess to block the valve; a pressing assembly including a bottom disc urging against the steel ball, a hollow cylinder extending upward from a center of the bottom disc, a magnet in a bottom end of the hollow cylinder, a rod having a lower portion in the hollow cylinder to engage with the magnet, and a pin disposed through the hollow cylinder and the rod to fasten the hollow cylinder and the rod together; an intermediate, hollow, cylindrical member threadedly secured to the hollow, cylindrical base; a cup-shaped cap threadedly secured to the cylindrical member and including two opposing projections on an inner surface, a well, and a through hole through a bottom of the well with an upper portion of the rod passing through; and a switch including a handle on a top and two opposing protrusions disposed under the projections respectively;

wherein the upper portion of the rod is secured to the switch, the cylindrical member is filled with pressurized air, and the magnet attracts the steel ball in a position blocking the valve.

* * * * *